US005257520A

United States Patent [19]

Miller

[11] Patent Number: 5,257,520

[45] Date of Patent: Nov. 2, 1993

[54] ENTRY PROTECTION DEVICE FOR COMBINATION DIAL LOCKS

[76] Inventor: J. Clayton Miller, 5085 Danville Rd., Nicholasville, Ky. 40356

[21] Appl. No.: 885,596

[22] Filed: May 19, 1992

[51] Int. Cl.[5] ..... E05B 15/00

[52] U.S. Cl. ..... 70/333 R; 70/333 A; 70/444; 70/DIG. 58

[58] Field of Search ..... 70/158, 163, 166, DIG. 43, 70/444–446, 207, 209, 232, 334, DIG. 56, DIG. 58, 1.5, 1.7, 333 R, 333 A, 332

[56] References Cited

U.S. PATENT DOCUMENTS

| | | | |
|---|---|---|---|
| 200,599 | 2/1878 | Beachman | 70/232 |
| 620,091 | 2/1899 | Applin | 70/DIG. 58 X |
| 629,999 | 8/1899 | Jacobs | 70/445 |
| 732,197 | 6/1903 | Lietz | 70/DIG. 56 X |
| 1,166,231 | 12/1915 | Lewis | 70/208 X |
| 1,655,002 | 1/1928 | Winning et al. | 70/332 |
| 1,829,444 | 10/1931 | Goebel et al. | 70/DIG. 58 X |
| 1,855,947 | 4/1932 | Disbrow | 70/333 A |
| 2,020,879 | 11/1935 | Eldred | 70/333 A |
| 2,062,067 | 11/1936 | Miller | 70/166 |
| 3,098,376 | 7/1963 | Miller | 70/333 R |
| 3,270,534 | 9/1966 | Junkunc | 70/333 R |
| 4,326,740 | 4/1982 | Guiler | 70/232 X |

FOREIGN PATENT DOCUMENTS

| | | | |
|---|---|---|---|
| 217649 | 12/1967 | Sweden | 70/DIG. 58 |

*Primary Examiner*—Lloyd A. Gall

*Attorney, Agent, or Firm*—Lowe, Price, LeBlanc & Becker

[57] ABSTRACT

An entry protection device for use with combination dial locks includes a flange annulus which permits removable attachment to a combination dial. The flanges are disposed between the rear surface of the combination dial and the facing surface of a security container to prevent unauthorized removal of the entry protection device. The entry protection device includes indicators to permit detection of surreptitious entry by penetration or removal of the device. The entry protection device includes an anti-rotation feature which prevents continuous 360° rotation of a combination knob by an automatic dialing machine but allows hand manipulation of the dial by a user. The device may be combined with a combination dial having an irregularly shaped dial knob surface to prevent engagement of the dial knob by an automatic dialing machine.

22 Claims, 5 Drawing Sheets

ENTRY PROTECTION DEVICE FOR COMBINATION DIAL LOCKS

TECHNICAL FIELD

The present invention relates to an entry protection device for combination dial locks, and in particular, to a device removably attachable to the combination dial to prevent entry by automatic dialers and to identify tampering.

BACKGROUND ART

In the prior art, clear plastic shields, commonly referred to as dust covers, have been proposed for use with combination dial locks. The dust covers are designed to keep fingerprints off the dial and dial ring so that print segments cannot later be re-aligned for discovery of the numbers of the combination. Typically, prior dust covers are annular in shape and are placed over the face of the combination dial for removability. However, prior art dust covers are often removed by authorized users of a combination lock. Once removed, protection against re-alignment and combination discovery through detection of fingerprints on the dial is lost.

It is also known in the field of combination locks to use automatic dialing machines to gain unauthorized access to a security container or secured area. One type of automatic dialing machine engages the grooves in a combination dial knob surface and rotates the combination dial 360° in a succession of predetermined sequences until the correct combination is obtained.

In view of the drawbacks described above for prior art dust covers and the use of automatic dialing machines to gain surreptitious entry, a need has developed to provide improved entry protection devices to effectively limit the use of automatic dialers and fingerprinting of print segments to discover combination number sequences.

In response to this need, the present invention provides an improved entry protection device for combination dial locks which prevents the use of automatic dialing machines and thumb printing of combination dial surfaces to obtain surreptitious entry. The present invention includes indicia features which permit detection of tampering with combination locks, replacement lock or components or unauthorized entry into a combination lock security container or secured area.

DISCLOSURE OF THE INVENTION

Accordingly, a first object of the present invention is to provide an improved entry protection device for use with combination dial locks.

A further object of the present invention is to prevent use of 360° rotation automatic dialing machines to dial locks while allowing a user to comfortably manipulate a lock dial to achieve the correct combination.

Another object is to provide an entry protection device which is only removable from the inside of a security container or secured area by combination lock disassembly.

A still further object of the present invention is to include indicia on an entry protection device to permit detection of tampering or replacement of the device and unauthorized entry into the security container.

Other objects and advantages of the present invention will become apparent as a description thereof proceeds.

In satisfaction the foregoing objects and advantages, the present invention comprises an entry protection device for a combination dial lock that includes an annulus designed to be removably attached to a combination dial. The annulus has a pair of flanges which together with a rear face of the annulus, form a chamber to receive and engage a combination dial. The combination dial is inserted into the chamber by compression of the annulus at points along a circumferential surface thereof to expand the distance between the flanges to permit dial insertion. The annulus can be attached to or removed from the combination dial only when the dial is removed from the combination lock. Thus, the entry protection device cannot be removed from the dial from the outside of a security container or secured area without breaking the entry protection device, an indication of unauthorized entry or tampering.

Connected to the annulus also is an anti-rotation device which includes an L-shaped cap member extending upwardly from the front face of the annulus. The L-shaped cap member is contoured to receive a user's thumb and finger to facilitate manipulation of the combination. The L-shaped cap member prevents tampering by covering the dial knob face. By attachment to the annulus on the front face at a single location, the anti-rotation device prevents 360° or greater continuous rotation characteristic of an automatic dialing machine but permits a 180° rotation for hand manipulation of the combination lock.

In another aspect of the invention, the rear surfaces of the annulus may include indicia or a treated surface to indicate tampering or surreptitious entry. Arranging the indicia on the rear surfaces of the annulus prevents masking or repair of the indicia since the rear surfaces are inaccessible unless the device is broken and removed. In a further embodiment of the entry protection device, the L-shaped cap may be configured to adapt to manipulation proof locks by the use of an adapter and a countersunk bore in the rear face of the cap.

In a still further embodiment of the invention, the entry protection device can be used in combination with a combination dial wherein the dial knob side surface has an irregular contour to prevent multiple gear rotation of the combination dial and unauthorized entry into a security container or secured area.

BRIEF DESCRIPTION OF DRAWINGS

Reference is now made to the drawings accompanying the application wherein.

FIGS. *7a* and *7c* are side views of combination dial knob surfaces which are particularly adapted for use with the inventive entry protection device;

FIG. *7b* and *7d* are cross-sectional views along the lines "B" and "D" of FIGS. *7a* and *7b*, respectively.

Figure 1:
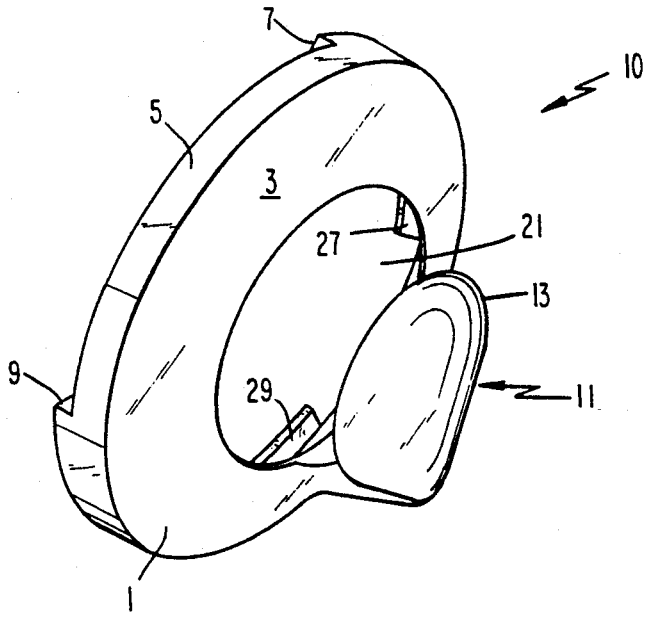
FIG. 1 is a front perspective view of a first embodiment of the inventive entry protection device removed from a combination dial to show greater detail.
Figure 8:
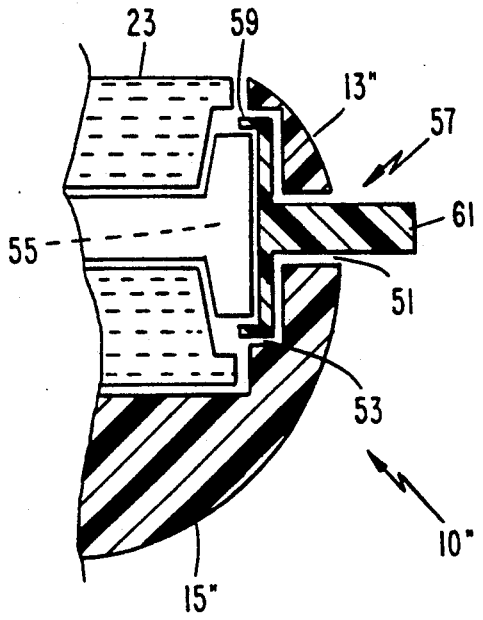
Figure 9:
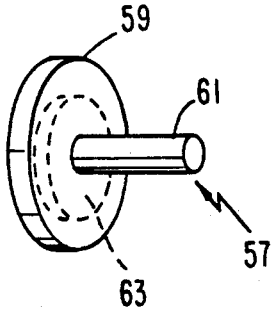
Figure 10:
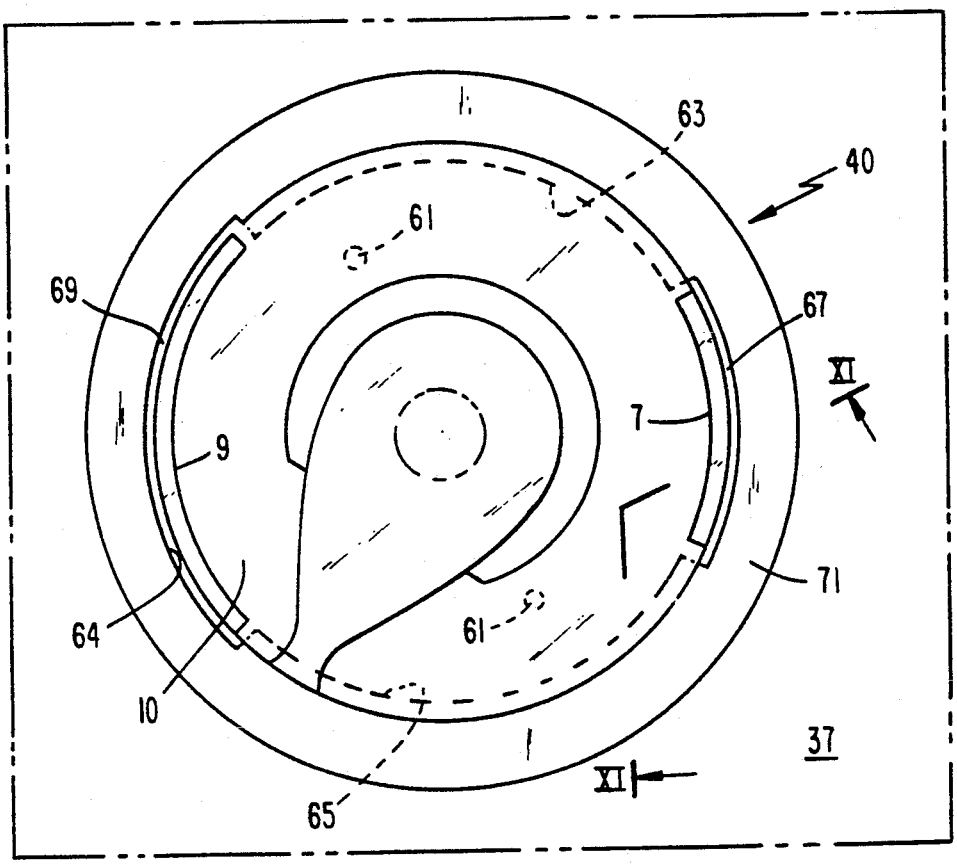
Figure 11:
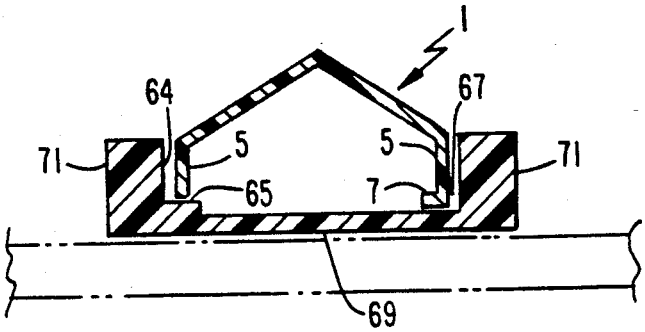

FIG. 8 is a cross-sectional view of another embodiment of the entry protection device adapted for use with manipulation proof combination locks;

FIG. 9 is a perspective view of the adapter shown in FIG. 8;

FIG. 10 is a front view of the entry protection device depicted in FIG. 1 engaging a dial ring; and FIG. 11 is a cross-sectional view along the lines XI—XI depicted in FIG. 10.

DESCRIPTION OF THE PREFERRED EMBODIMENTS

The present invention provides an entry protection device for use with combination dial locks. In one aspect, the entry protection device functions as a dust cover to prevent fingerprint dusting of the dial face and determination of the combination of a combination lock.

The entry protection device is removable from the combination dial only by accessing the interior of a security container or secured area and the combination dial lock mechanism. Once the combination lock is locked such that an intruder cannot gain access to the lock mechanism, the entry protection device cannot be removed without being broken. Any breakage indicates tampering or surreptitious entry into the security container or secured area.

An anti-rotation feature of the invention prevents 360° rotation of a combination dial. The anti-rotation feature includes a cap covering the front face of the combination dial to prevent tampering with it. The leg of the anti-rotation feature is contoured to receive a user's thumb and finger to facilitate comfortable manipulation of the combination dial.

The entry protection device may also include indicia such as a serial number on the rear surface of it so as to be inaccessible without removing the entry protection device. Thus, if the entry protection device is broken and replaced by a similar type, the replacement entry protection device will not have the correct serial number. A different serial number indicates that the entry protection device has been replaced and also indicates possible entry into the security container or secured area.

Additional indicia may be placed on rear surfaces of the entry protection device to indicate penetration through it. By providing indicia on inner or rear surfaces of the entry protection device, attempts to mask or cover the penetration area cannot access the inner surfaces of the entry protection device. Thus, penetration through the entry protection device can be easily detected.

The entry protection device may also be used in combination with a novel combination dial. The novel combination dial includes a dial knob having a surface on the dial knob side which prevents accurate engagement with the dial knob and rotation of it by a multiple geared automatic dialing machine. Thus, even with the entry protection device in place, an automatic dialing machine employing a pair of gears to fully rotate the combination dial 360° cannot adequately engage the combination dial knob surface to complete the requisite sequencing of combination possibilities to unlock the combination lock.

Figure 2:
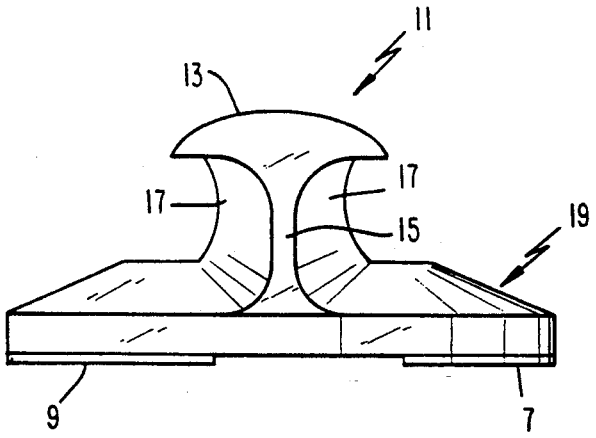
FIG. 2 is a bottom view of the entry protection device depicted in FIG. 1.

With reference now to FIGS. 1 and 2, an entry protection device generally designated by the reference numeral 10 is seen to include an annulus 1 having a front face 3 and side wall 5. Arranged along a circumferential edge of the side wall 5 is a pair of flanges 7 and 9. The flanges 7 and 9 are generally diametrically opposed and flange 9 has a greater arcuate length than flange 7. This difference in length facilitates attachment of the entry protection device to a combination dial, as will be described hereinafter.

Extending outwardly from the face 3 is an anti-rotation device 11. The device 11 includes a cap 13 which is shaped to cover the front face of a combination dial knob and a leg 15 interconnecting the cap 13 and the annulus 1. The leg 15 includes a pair of contoured recesses 17, designed to receive a user's thumb and finger to facilitate comfortable manipulation of a combination dial.

By attaching the anti-rotation device 11 at one location on the annulus 1, 360° or greater continuous manipulation of a combination dial is prevented whereas a user can hand manipulate the combination dial at least by 180°.

The annulus 1 also includes a bevel 19 which is designed to follow the contours of one type of combination dial.

Figure 3:
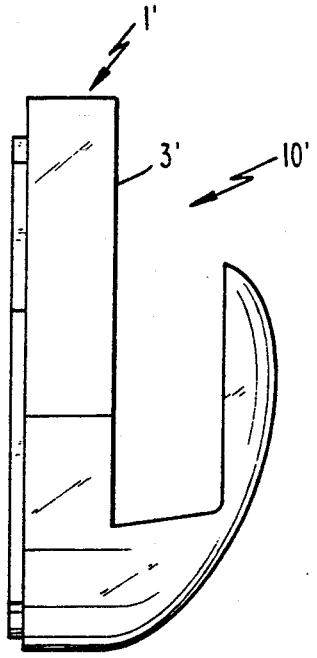
FIG. 3 is a side view of another embodiment of an entry protection device.

Alternatively, and with particular reference to FIG. 3, another embodiment of the entry protection device is generally designated as 10'. In this embodiment, the annulus 1' has a flat surface 3' to accommodate another type of prior art combination dial.

Figure 4:
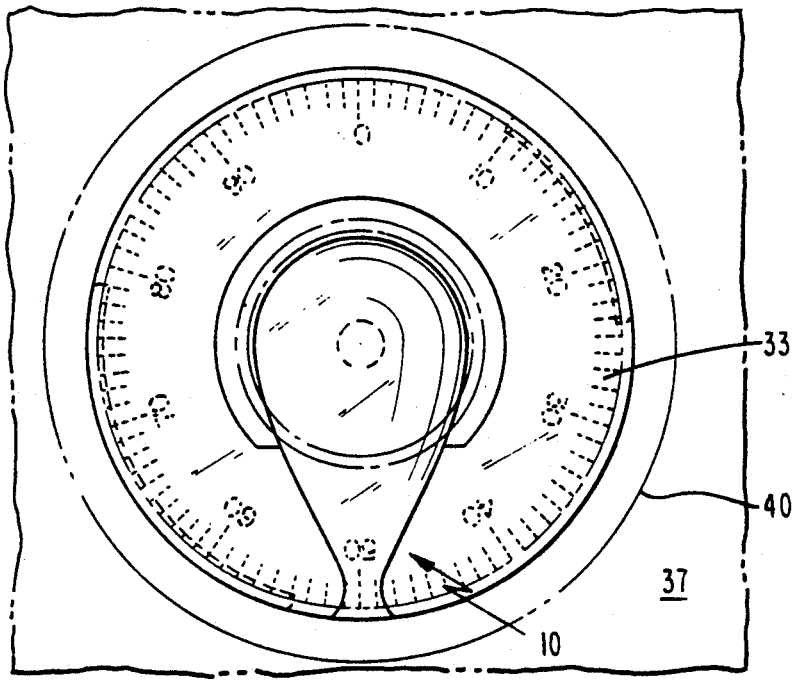
FIG. 4 is a front view of one embodiment of the entry protection device in an exemplary use.
Figure 5:
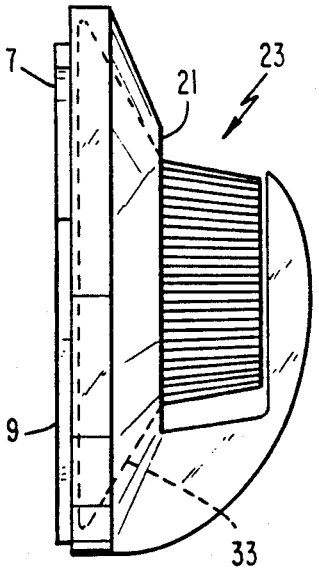
FIG. 5 is a side view of the arrangement depicted in FIG. 4 removed from the dial ring and security container surface to show greater detail.

With reference now to FIGS. 1, 2 and 4-6, the manner in which the entry protection device is attached to a combination dial will be described. The annulus 1 includes an opening 21 which is designed to receive a combination dial knob 23 (FIG. 5). The rear face 25 of the annulus 1, the inner surface 20 of the side wall 5 and inner surfaces of the flanges 27 and 29, respectively, form a chamber 31 which receives and engages a combination dial 33. In FIG. 5, the entry protection device is shown engaging a combination dial 33.

In FIG. 4, the entry protection device is shown attached to a combination dial 33. The combination dial 33 and entry protection device 10 are located on the surface 37 of a security container and surrounded by a dial ring 40. The function of the dial ring 40 will be described in more detail hereinafter.

With reference now to FIG. 5, the combination dial and entry protection device are shown removed from the dial ring 40 and security container face 37. The flanges 7 and 9 of the entry protection device are adjacent the rear surface of the combination dial 33 and, thus, positioned between the combination dial 33 and the security container outer face 37. In this manner, and assuming the security container is unopened, the entry protection device cannot be removed except by breaking the entry protection device from the dial. Otherwise, the security container must be opened and the combination dial removed from the combination lock assembly to permit removal of the entry protection device.

Figure 6:
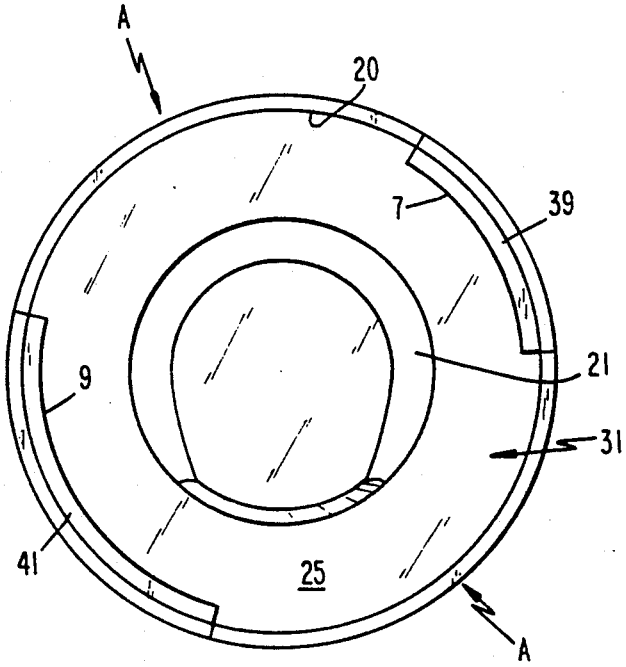
FIG. 6 is a rear view of the entry protection device depicted in FIG. 1.
Figure 7A:
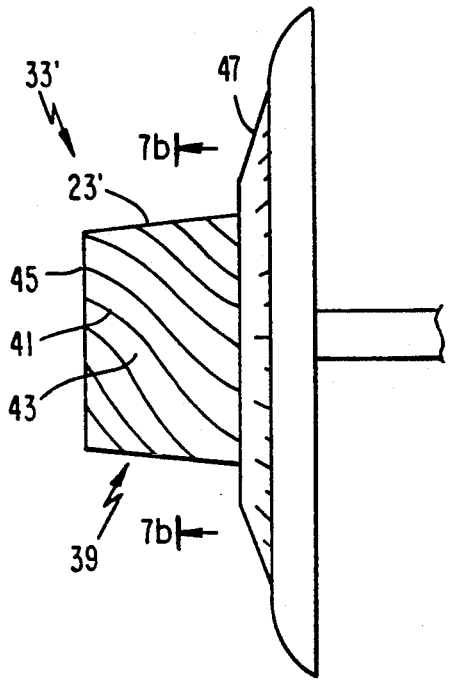
Figure 7B:
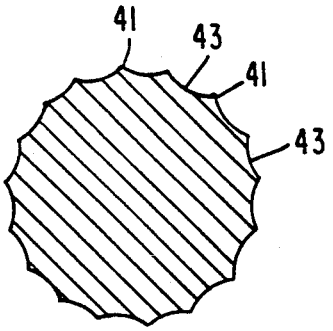
Figure 7C:
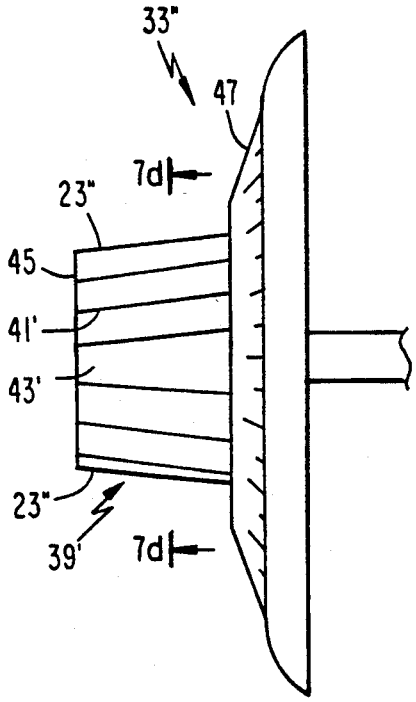
Figure 7D:
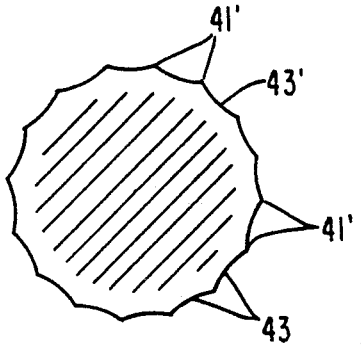

With particular reference to FIG. 6, the combination dial 33 is inserted into the chamber 31 by compressing the annulus 1 at the points indicated by the arrows A. Since the entry protection device is made of a resilient material such as a plastic, the side wall 5 compresses at the points A which expands the distance between the flanges 7 and 9. While the entry protection device is compressed at points A, a combination dial can be inserted by first sliding one edge past flange 9 followed by sliding an opposite edge thereof past flange 7. The combination dial 33 is removed in a similar manner by repeating the steps described above in opposite order. That is, the annulus 1 is compressed and a first edge of the combination dial is slipped past flange 7 followed by slipping a second edge of the combination dial past flange 9.

Alternatively, the flanges 7 and 9 may be sized such that the combination dial 33 may be inserted into the chamber 31 without requiring compression of the annulus 1. The flanges 7 and 9 should be sized such that the combination dial, merely by inserting the combination dial 33 into the chamber 31 at an angle to avoid flange 9 followed by sliding the dial past flange 7. The combination dial 33 would be removed in a similar manner. That is, the annulus 1 would be shifted in position such than an outer edge thereof could slip past flange 7. After the edge is past flange 7, the dial may be removed from the chamber 31. It should be understood that the chamber 31 should be of sufficient size so as to permit shifting of the combination dial when inserted in the chamber to permit removal from the entry protection device.

It should be understood that the flanges 7 and 9 extend from the inner surface 20 of the side wall 5 sufficiently to permit engagement of the rear surface of the combination dial 33 when the annulus is uncompressed. However, the flanges 7 and 9 must be limited in length from the inner surface 20 so as to permit insertion and removal of a combination dial in the chamber 31.

Still with reference to FIG. 6, the surface 25 of the annulus may be treated to further indicate tampering or penetration of the entry protection device. For example, the surface 25 may be sand blasted or coated with a reflective material using known techniques to provide a continuous surface of different texture or composition than the front surface 3 of the annulus 1. In this manner, once the integrity of the surface 25 is disrupted by, for example, penetration through the annulus 1, repair of the penetration hole on the surface 3 of the annulus 1 cannot undo the damage done to the treated surface 25. Thus, discontinuities in the surface 25 will serve as an indicator of unauthorized penetration through the entry protection device.

Further, the flange surfaces 39 and 41 of the flanges 7 and 9, respectively, may carry indicia. For example, a serial number may be stamped or printed on either or both of the flanges. In this manner, replacement of the entry protection device can be detected by the absence of a serial number on a replacement entry protection device or the presence of a serial number that does not correspond with the registered serial number for the particular entry protection device. It is unlikely that, during attempted surreptitious entry of a security container, the correct serial number can be imprinted on a replacement entry protection device.

With reference now to FIGS. *7a* and *7b*, and in accordance with another aspect of the present invention, a novel combination dial 33' is depicted with a novel combination dial knob 23', the knob 23' having an irregular circumferential surface 39. In FIG. *7a*, the side surface 39 comprises a plurality of ridges 41 and adjacent curved faces 43 disposed around the circumferential surface 39 of the knob 23'. By providing the ridges 41 extending from the knob face 45 to the dial face 47 in a curved or non-linear fashion, an irregular surface is provided which cannot be accurately engaged by the gripper of an automatic dialing machine.

Likewise, in FIGS. *7c* and *7d* another embodiment of an irregular surface 39' includes a plurality of ridges 41' and adjacent faces 43'. In this embodiment, the faces 43' are flat and, are sufficiently wide and increase in width longitudinally to prevent a geared device from accurately engaging adjacent ridge and face pairs to accurately manipulate the combination dial.

In a preferred embodiment, the combination dial having an irregular surface may be combined with the entry protection device to prevent combination dial manipulation by a dual or multiple gear driven automatic dialing machine which can rotate the combination dial by 360° or greater rotation. The combination dials depicted in FIGS. *7a* and *7c* may be used with combination lock assemblies alone to prevent accurate gripping of the combination dial knob by automatic dialing machines.

With reference now to FIGS. 8 and 9, another embodiment of the entry protection device is shown and generally designated by the reference numeral 10''. This embodiment is designed to function with manipulation-proof locks which typically employ a locking knob disposed on the end face of the combination dial knob. To unlock these types of locks, the combination must be dialed and then the knob must be turned to unlock the lock. With reference now to FIG. 8, the leg 15'' terminates in a cap 13'' having a through-bore 51. The bore 51 includes an enlarged diameter portion 53 which is designed to house an adapter 57. The adapter 57 has a pin portion 61 which is designed to extend through the bore 51 in the cap 13''. The adapter 57 has an adapter body 59 which includes a recess 63 configured on a base surface to receive the locking knob of a manipulation proof lock, designated as 55 in FIG. 8. The adapter body 59 is designed to permit rotation of the manipulation proof locking knob 55 by rotation of the pin 61 extending through the bore 51 in the cap 13''. Thus, the entry protection device accommodate these types of locks while providing the entry protection measures described above. It should be understood that the pin 61 may also include a removable knurled knob that can be attached in any known fashion to further facilitate rotation of the locking knob 55 via the pin 61.

FIG. 10 shows in greater detail the arrangement of the entry protection device with an exemplary dial ring and a security container. In FIG. 10, the entry protection device 10 is shown disposed within the dial ring 40 with the combination dial removed for purposes of clarity. The dial ring is designed to attach to the security container surface 37 by fasteners (not shown) through the openings 61.

The dial ring 40 includes a pair of flanges 63 and 65 which cooperate with the flanges 7 and 9 of the entry protection device 10 to prevent rotation. The narrow edges of the flanges 63 and 65 and a portion of the inner ring surface 64 of the wall section 71 form a recess 67 to receive flange 7 and a recess 69 to receive flange 9, respectively. In this manner, and since the dial ring is rigidly attached to the outer surface 37, the entry protection device is prevented from rotating during combination dial manipulation.

FIG. 11 further illustrates the recess 67 for engagement of the flange 7 and the step 65. The dial ring includes a base 69, that, together with wall section 71, houses the combination dial and entry protection device.

It should be noted that the dial ring depicted in FIG. 10 is merely exemplary of a device to prevent rotation of the entry protection device once attached to the combination dial. Alternatively, stops or other means may be employed with known dial rings to prevent rotation of the entry protection device. These stops can include a fastener drilled through the dial ring in the appropriate places to prevent rotation by engaging the flanges 7 and 9.

The entry protection device of the present invention preferably is made of a plastic material which is sufficiently translucent such that the markings on the combination dial can be seen. Moreover, the plastic should be of sufficient resiliency that the annulus can be compressed as described above without permanent deformation or breakage.

It should be understood that the entry protection device 10 can be used on any combination dial lock assemblies including those with spy-proof dial rings. In use with spy-proof dial rings, the sidewall 5 is sufficiently translucent to permit viewing of the markings on the combination dial through the slot in the spy-proof dial ring.

As such, an invention has been disclosed in terms of preferred embodiments thereof which will fulfill each and every one of the objects of the present invention as set forth hereinabove and provides a new and improved entry protection device for use with combination dial locks.

Various changes, modifications and alterations from the teachings of the present invention may be contemplated by those skilled in the art without departing from the intended spirit and scope thereof. Accordingly, it is intended that the present invention only be limited by the terms of the appended claims.

I claim:

1. An entry protection device for use with a combination dial lock comprising:

a) an annular member having an outer face and an inner face, said annular member including an opening therethrough sized to receive a dial knob of a combination dial, said dial knob having an end surface and a sidewall;

b) means integrally attached to said annular member for forming a chamber to removably receive said combination dial; and c) means, attached to said annular member and protruding therefrom so as to cover only a portion of the sidewall of said dial knob and expose a greater than 180° continuous sector of the remainder of the sidewall, for preventing continuous gripping and 360° or greater rotation of the dial knob by a machine while permitting said dial knob to be rotated by at least 180° as the dial knob is gripped continuously by the fingers of an operator's hand.

2. An entry protection device of claim 1, wherein said means for forming a chamber comprises a side wall integrally extending from an edge of said annular member and a pair of flanges extending inwardly from a peripheral edge of said side wall, said flanges, said side wall and said inner face of said annular member forming said chamber, and wherein said flanges are sized to permit insertion or removal of said combination dial from said chamber.

3. An entry protection device of claim 2, wherein said annular member and said side wall are made of a resilient plastic material such that portions of said side wall can be compressed to enlarge a spacing between said flanges to permit removal or insertion of said combination dial into said chamber.

4. An entry protection device of claim 1, wherein said means for preventing continuous gripping of said dial knob comprises an L-shaped member including a leg extending outwardly from said outer face and a cap attached to a distal end of said leg, said cap adapted to cover said end surface of said dial knob on said combination dial and said leg adapted to prevent continuous gripping of said dial knob by a machine as the dial knob is attempted to be rotated by at least 360°.

5. An entry protection device of claim 4, wherein said leg includes a pair of contoured recesses to receive a thumb and finger for comfortable manipulation of said dial knob.

6. An entry protection device of claim 4, wherein said means for preventing continuous gripping of said dial knob further comprises means for permitting rotation of a manipulation proof combination lock knob through said cap.

7. An entry protection device of claim 6, wherein said means for permitting rotation of said manipulation proof combination lock knob comprises a bore through said cap and an adaptor, said adaptor including a pin and adaptor body, said pin extending outwardly from said adaptor body and through said bore, said adaptor body having a recess for receiving said manipulation proof combination lock knob such that rotation of said pin permits rotation of said manipulation proof combination lock knob.

8. An entry protection device of claim 1 comprising indicia on said means for forming said chamber for indicating entry or tampering with either said combination dial lock or said entry protection device.

9. An entry protection device of claim 8, wherein said indicia comprises a numerical indicator.

10. An entry protection device of claim 8, wherein said indicia further comprises means on said inner face for indicating entry or tampering with said combination dial lock.

11. An entry protection device of claim 10, wherein said means on said inner face comprises a reflective material coating on said inner face.

12. An entry protection device of claim 10, wherein said means on said inner face comprises a sand blasted surface on said inner face.

13. An entry protection device of claim 1, further comprising a dial ring having means to prevent rotation of said entry protection device arranged on a surface thereof.

14. An entry protection device of claim 13, wherein said means to prevent rotation of said entry protection device comprises a pair of steps extending inwardly from a peripheral flange of said dial ring and in spaced relationship therealong, said steps adapted to engage a portion of said means for forming a chamber.

15. An entry protection device for use with a combination dial lock, comprising a) an entry protection device including i) an annular member having an outer face and an inner face, said annular member including an opening therethrough sized to receive a dial knob of a combination dial, said dial knob having an end surface and a sidewall;

ii) means integrally attached to said annular member for forming a chamber to removably receive said combination dial; and iii) means, attached to said annular member and protruding therefrom so as to cover only a portion of the sidewall of said dial knob and expose a greater than 180° continuous sector of the remainder of the sidewall, for preventing continuous gripping and 360° or greater rotation of the dial knob by a machine while permitting said dial knob to be rotated by at least 180° as the dial knob is gripped continuously by the fingers of an operator's hand;

b) said sidewall having a discontinuous circumferential surface for preventing gripping thereto by an automatic dialer.

16. An entry protection device of claim 15, wherein said means for forming a chamber comprises a side wall extending from an edge of said annular member and a pair of flanges extending inwardly from a peripheral edge of said side wall, said flanges, said side wall and said inner face of said annular member forming said chamber, and wherein said flanges are sized to permit insertion or removal of said combination dial from said chamber.

17. An entry protection device of claim 15, wherein said means for preventing continuous gripping of said dial knob comprises an L-shaped member including a leg extending outwardly from said outer face and a cap attached to a distal end of said leg, said cap adapted to cover said end surface of said dial knob and said leg adapted to prevent continuous gripping of said dial knob by machine as the dial knob is attempted to be rotated by at least 360°.

18. An entry protection device of claim 17, wherein said means for preventing continuous gripping of said dial knob further comprises means for permitting rotation of a manipulation proof combination dial knob through said cap.

19. An entry protection device of claim 18, wherein said means for permitting rotation of said manipulation proof combination dial knob comprises a bore through said cap and an adaptor, said adaptor including a pin and adaptor body, said pin extending outwardly from said adaptor body and designed to extend through said bore, said adaptor body having a recess therein for receiving said manipulation proof combination dial knob, such that rotation of said pin permits rotation of said manipulation proof combination dial knob.

20. An entry protection device of claim 15 comprising indicia on said means for forming said chamber for indicating entry or tempering with either of said combination dial lock or said entry protection device.

21. An entry protection device of claim 15, further comprising a dial ring having means to prevent rotation of said entry protection device arranged on a surface thereof.

22. An entry protection device of claim 21, wherein said means to prevent rotation of said entry protection device comprises a pair of steps extending inwardly from a peripheral flange of said dial ring and in spaced relationship therealong, said steps adapted to engage a portion of said means for forming a chamber.

* * * * *